US006076921A

United States Patent [19]

Rezanka et al.

[11] Patent Number: 6,076,921

[45] Date of Patent: Jun. 20, 2000

[54] INK JET PRINTER HAVING AN EFFICIENT SUBSTRATE HEATING AND SUPPORTING ASSEMBLY

[75] Inventors: Ivan Rezanka, Pittsford; Dale R. Ims, Webster; Narayan V. Deshpande, Penfield, all of N.Y.

[73] Assignee: Xerox Corporation, Stamford, Conn.

[21] Appl. No.: 09/032,922

[22] Filed: Mar. 2, 1998

[51] Int. Cl.[7] ..... B41J 2/01

[52] U.S. Cl. ..... 347/102

[58] Field of Search ..... 347/101, 102, 347/17; 400/120.08, 120.18, 662; 101/424.1, 487

[56] References Cited

U.S. PATENT DOCUMENTS

| | | | |
|---|---|---|---|
| 4,849,774 | 7/1989 | Endo et al. . | |
| 4,982,207 | 1/1991 | Tunmore et al. . | |
| 5,467,119 | 11/1995 | Richtsmeier et al. | 347/102 |
| 5,500,658 | 3/1996 | Hattori et al. | 347/22 |

FOREIGN PATENT DOCUMENTS

| | | |
|---|---|---|
| 2-151444 | 6/1990 | Japan . |
| 6-218913 | 8/1994 | Japan . |

*Primary Examiner*—Robert Beatty
*Attorney, Agent, or Firm*—Tallam I. Nguti

[57] ABSTRACT

A thermal ink jet printer including a frame, a printhead mounted to the frame for printing ink images onto a heated and supported substrate, and an efficient substrate heating and supporting assembly mounted to the frame. The efficient substrate heating and supporting assembly includes a heating device, and a substrate supporting member having a front surface including a substrate supporting area for supporting substrates of various sizes one at a time and border areas having a polished finish. The efficient substrate heating and supporting assembly also includes a heat absorbing back surface facing the heating device. The heat absorbing back surface includes an increased heat absorbing area located opposite and centered relative to the substrate supporting area on the front surface. The increased heat absorbing area, relative to a rest of the back surface, has a coat of paint thereon for increasing heat absorption thereinto from the heating device, thereby resulting advantageously in relatively nonuniform heat absorption into the back surface, and relatively in more uniform, adequate and efficient substrate heating and drying temperatures on the front surface, when continuously running a most often run size of substrates.

10 Claims, 4 Drawing Sheets

INK JET PRINTER HAVING AN EFFICIENT SUBSTRATE HEATING AND SUPPORTING ASSEMBLY

BACKGROUND OF THE INVENTION

The present invention relates generally to liquid ink recording apparatus or ink jet printers, and more particularly relates to such a recording apparatus including an efficient sheet or substrate heating and supporting assembly.

Liquid ink printers of the type frequently referred to either as continuous stream or as drop-on-demand, such as piezoelectric, acoustic, phase change wax-based or thermal, have at least one printhead from which droplets of ink are directed towards a recording sheet. Within the printhead, the ink is contained in a plurality of channels. For a drop-on-demand printhead power pulses cause the droplets of ink to be expelled as required from orifices or nozzles at the end of the channels.

In a thermal ink-jet printer, the power pulses are usually produced by formation and growth of vapor bubbles on heating elements or resistors, each located in a respective one of the channels, which are individually addressable to heat and vaporize ink in the channels. As voltage is applied across a selected resistor, a vapor bubble grows in the associated channel and initially expels the ink therein from the channel orifice, thereby forming a droplet moving in a direction away from the channel orifice and towards the recording medium where, upon hitting the recording medium, a dot or spot of ink is deposited. Following collapse of the vapor bubble the channel is refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a supported, stationary recording medium, such as paper or a transparency.

After the swath is printed, the paper is stepped a distance equal to the height of the printed swath or a portion thereof, so that the next printed swath is contiguous or overlapping therewith. This procedure is repeated until an entire page is printed. In contrast, the page width printer includes a stationary printhead having a length sufficient to print across the width or length of a supported sheet of recording medium at a time. The supported recording medium is continually moved past the page width printhead in a direction substantially normal to the printhead length and at a constant or varying speed during the printing process.

In either case, the substrate or sheet is supported and heated on a heating and supporting assembly that includes a platen and a heating device in order to dry the printed swath and prevent it from bleeding into an adjacent swath. Typically, the sheet supporting platen consists of a flat surface, or of a rotating hollow drum, that in either case, has a back surface, and a front surface that has an area which is large enough to support up to a legal size sheet, with border areas left over. In the case of a rotating hollow drum platen for example, heat is generated by a radiant heater or heating device mounted inside the hollow of the drum. In order to obviate the need for costly slip rings or other like contacts, the heating device is mounted to be stationary, while the drum rotates.

The heat ordinarily is delivered to the back or inner surface of the drum uniformly, and conventionally is absorbed uniformly through the inner surface and into the wall of the drum. Conventionally too, the heat is then ordinarily emitted uniformly from the front or outer surface of the drum. Unfortunately however, heat removal from the front surface by substrates or sheets being supported on an area of the front surface, depends significantly on the particular size of the sheet, and upon the frequency at which that particular size of sheet is being used or run through the printer.

For example, by far the most frequently used paper or sheet size in North America is the letter size or 8.5"×11" sheet. Typically, it is this sheet size that is used to base the main throughput rate specification, for example, 25 CPM (copy sheets per minute) of the ink jet printer. This letter size or 8.5"×11" sheet unfortunately however is supported on only about 69% of the front surface area of a 9"×15" drum or platen, that is large enough to also support, for example, 8.5"×14", legal size sheets. Therefore, for all the time the most-run or most-used, letter size or 8.5"×11" sheet is being run, heat is usefully taken out only from about 69% of the front surface area, while the remaining about 31% of the front surface area is unnecessarily and wastefully being overheated.

SUMMARY OF THE INVENTION

In accordance with the present invention, there is provided a thermal ink jet printer including a frame, a printhead mounted to the frame for printing ink images onto a heated and supported substrate, and an efficient substrate heating and supporting assembly mounted to the frame. The efficient substrate heating and supporting assembly includes a heating device, and a substrate supporting member having a front surface including a substrate supporting area for supporting substrates of various sizes one at a time. The efficient substrate heating and supporting assembly also includes a heat absorbing back surface facing the heating device. The heat absorbing back surface includes an increased heat absorbing area located opposite, and centered relative to the substrate supporting area on the front surface. The increased heat absorbing area, relative to a rest of the back surface, has a heat absorbing surface treatment or coating thereon for increasing heat absorption thereinto from the heating device, thereby resulting advantageously in relatively nonuniform heat absorption into the back surface, and relatively more uniform, adequate and efficient substrate heating and drying temperatures on the front surface, when continuously running a most often used size of substrates.

BRIEF DESCRIPTION OF THE DRAWINGS

In the detailed description of the invention presented below, reference is made to the drawings in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
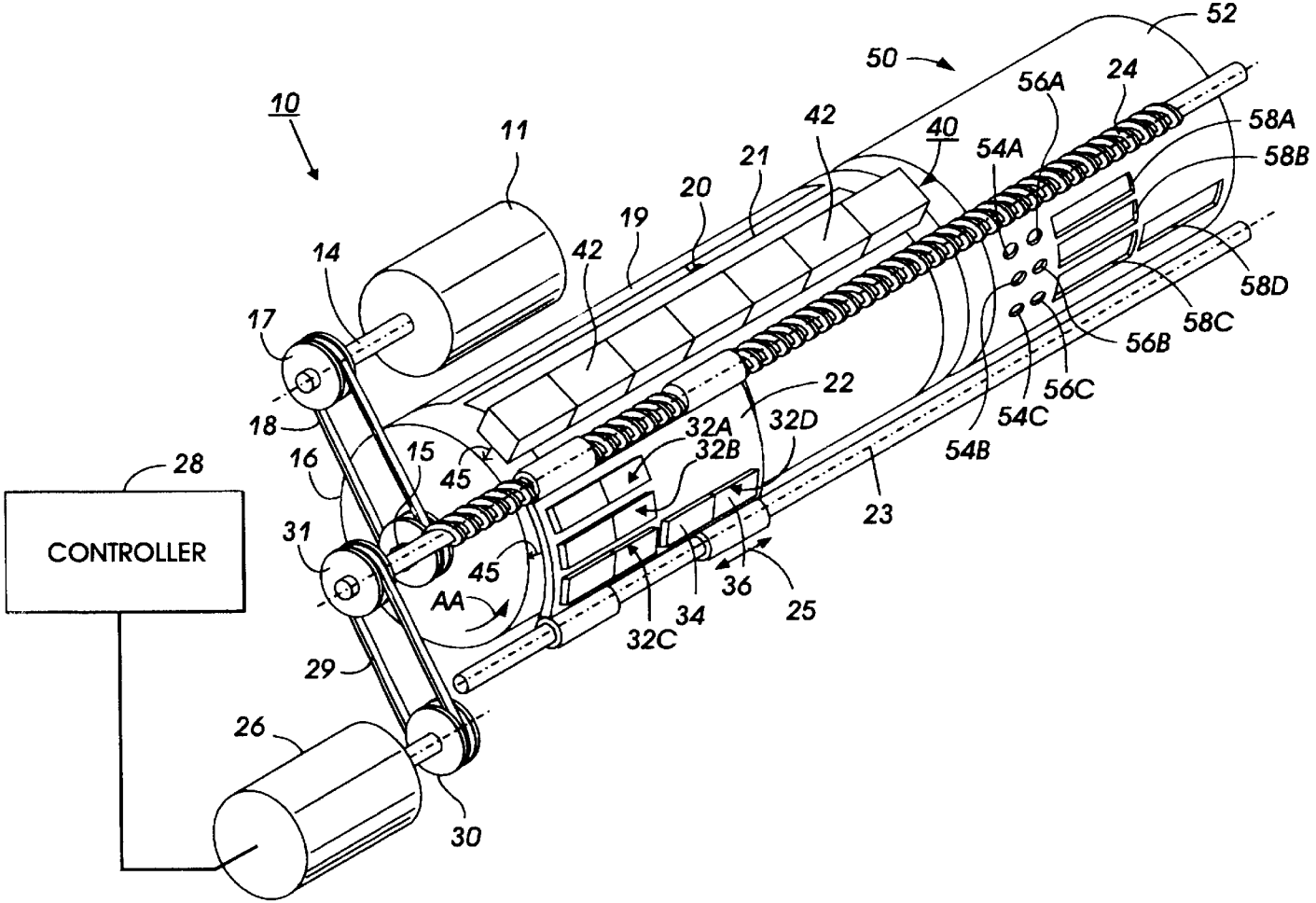
FIG. 1 illustrates a partial perspective view of an ink jet printing apparatus including and efficient sheet or substrate heating and supporting assembly in accordance with the present invention.

Referring now to FIG. 1, the essential components of a printing apparatus or printer, generally designated 10, are illustrated. As shown, the outside covers or case and associated supporting components of the printing apparatus 10 are omitted for clarity. The essential components of the printing apparatus 10 include a motor 11 connected to a suitable power supply (not shown) and arranged with an output shaft 14 parallel to an axis 15 of a rotatable cylindrical drum 16 of an efficient substrate heating and supporting assembly 60 of the present invention (to be described in detail below). A pulley 17 permits direct engagement of the output shaft 14, to a drive belt 18 for enabling the drum 16 to be continuously rotationally driven by the motor 11 in the direction of an arrow AA at a predetermined rotational speed.

A recording medium such as a sheet of paper or a transparency 19 (letter size or legal size) is placed over an outer surface 20 of the drum 16, with its leading edge 21 attached to the surface 20. Typically, the sheet is attached to the drum 16 either by the application of a vacuum, using holes in the drum 16 (not shown), or by other means of holding the sheet to the drum, for example, electrostatic means. In operation, as the drum 16 with a sheet 19 attached thereto rotates, it moves the sheet 19 with it past a printhead carriage 22.

The printhead carriage 22 is supported for example by a lead screw 24 that is mounted so that its axis is parallel to the axis 15 of the drum 16. Additionally, it is supported by fixed bearings (not shown) which enable it (the carriage 22) to be capable of sidably translating axially. A carriage rail 23 provides further support for the carriage 22 as it moves in the direction of arrow 25, that is perpendicular to the moving direction of the sheet 19. A second motor 26, such as a stepper motor or other positioning mechanism, which is controlled by a controller 28, drives the lead screw 24 with a second belt 29. As shown, the belt 29 is connected to a clutch 30, and to another clutch 31 that is attached to the lead screw 24 for movement thereof.

The printer 10, for example, includes printhead partial width arrays 32 that are each filled or charged with printing ink. The printhead partial width arrays 32 comprise a first partial width array printbar 32A, a second partial width array printbar 32B, a third partial width array printbar 32C, and a fourth partial width array printbar 32D. Each printbar 32A–32D as shown includes at least a printhead 34, or as preferred here, two printheads, a first printhead 34 and a second printhead 36 that are butted together to form such printbar.

Each of the printheads 34 and 36 includes several hundred or more channels and nozzles which in operation can be fired sequentially. In operation the partial width arrays 32, when charged or filled with ink, can be moved in the direction of arrow 25 for printing on the sheet. When filled with ink as such, the first, second and third partial width array printbars 32A–32C, respectively, will each contain ink of one of the colors cyan, magenta or yellow, for color printing. The fourth partial width array printbar 32D will contain black ink when necessary, especially when needed for printing graphics.

In addition to the partial width arrays 32, the printer 10 may also include a full-width array or pagewidth printbar 40 that is also filled or charged with printing ink. The pagewidth printbar 40 is supported by an appropriate support structure (not shown) above the drum 16 for printing on the recording medium when filled or charged with printing ink. The pagewidth printbar 40 has a length sufficient to print across the entire width (or length) of the recording medium during a single pass of the recording medium beneath the printbar. The printbar 40 as shown, includes a plurality of printhead units 42 that are affixed to a supporting member (not shown) in an abutted fashion. Alternatively, individual printhead units 42 may be spaced from one another by a distance approximately equal to the length of a single printhead subunit and bonded to opposing surfaces of the supporting member.

In each case, a front or forward facing edge of each printhead unit 34, 36 and 42, contains liquid droplet ejecting orifices or nozzles which can in operation, eject ink droplets along a trajectory 45 (FIG. 1), which is substantially perpendicular to the surface of a recording medium. As is well known, each printhead contains heating elements and printed wiring boards (not shown). The printed wiring boards contain circuitry required to interface and cause the individual heating elements in the printhead units to eject liquid (e.g. ink) droplets from the nozzles. While not shown, the printed wiring boards are connected to individual contacts contained on the printhead units via a commonly known wire bonding technique. The data required to drive the individual heating elements is supplied from an external system by a standard printer interface, modified and/or buffered by a printer micro processor (not shown) within the printer.

Referring again to FIG. 1, the printer or printing apparatus 10 preferably includes a maintenance system 50 located at one end of the drum 16 for preventing the nozzles in particular from drying out during idle periods following the printhead being filled with ink as above. The maintenance system 50 includes assemblies which provide wet wiping of the nozzles of the printheads 32 and 34 as well as vacuuming of the same printheads for maintenance thereof. Wet wipers and vacuuming of nozzles typically include a fluid applicator and vacuum means that are located within a stationary drum housing 52 and extend through a plurality of apertures 54A, 54B and 54C when necessary to provide maintenance functions. When the printhead carriage moves to the maintenance position, the wet wipers apply a fluid to the ink jet nozzles such that any dried ink, viscous plugs or other debris is loosened on the front face of the ink jet printbars. Once the debris has been sufficiently loosened, a plurality of vacuum nozzles each extending through a plurality of vacuum nozzle apertures 56A–56C vacuum away any of the cleaning fluid as well as any debris loosened thereby.

Once a printing operation has been completed and any cleaning of the printbars has been completed, if necessary, the carriage 22 is moved into position above another plurality of apertures 58A–58D. A plurality of capping members disposed within the housing 50, are moved into contact with the front faces of the printbars 32 and 34 through the apertures 58A–58D to thereby cap nozzles of the printheads in order to substantially prevent any ink which has been collected in the nozzles of the printheads from drying out.

Figure 2:
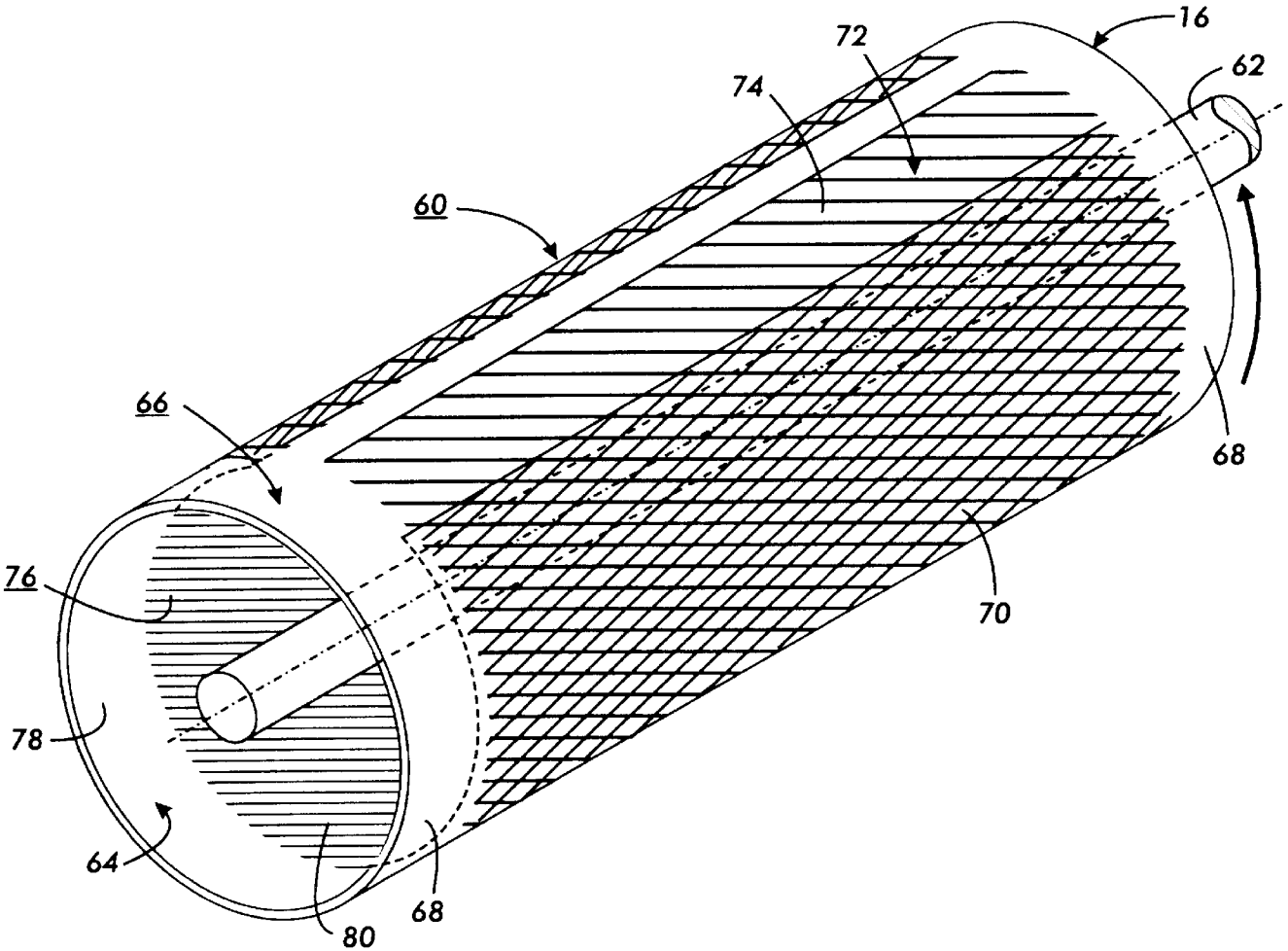
FIG. 2 is a perspective illustration of the efficient substrate heating and supporting assembly of FIG. 1.
Figure 3:
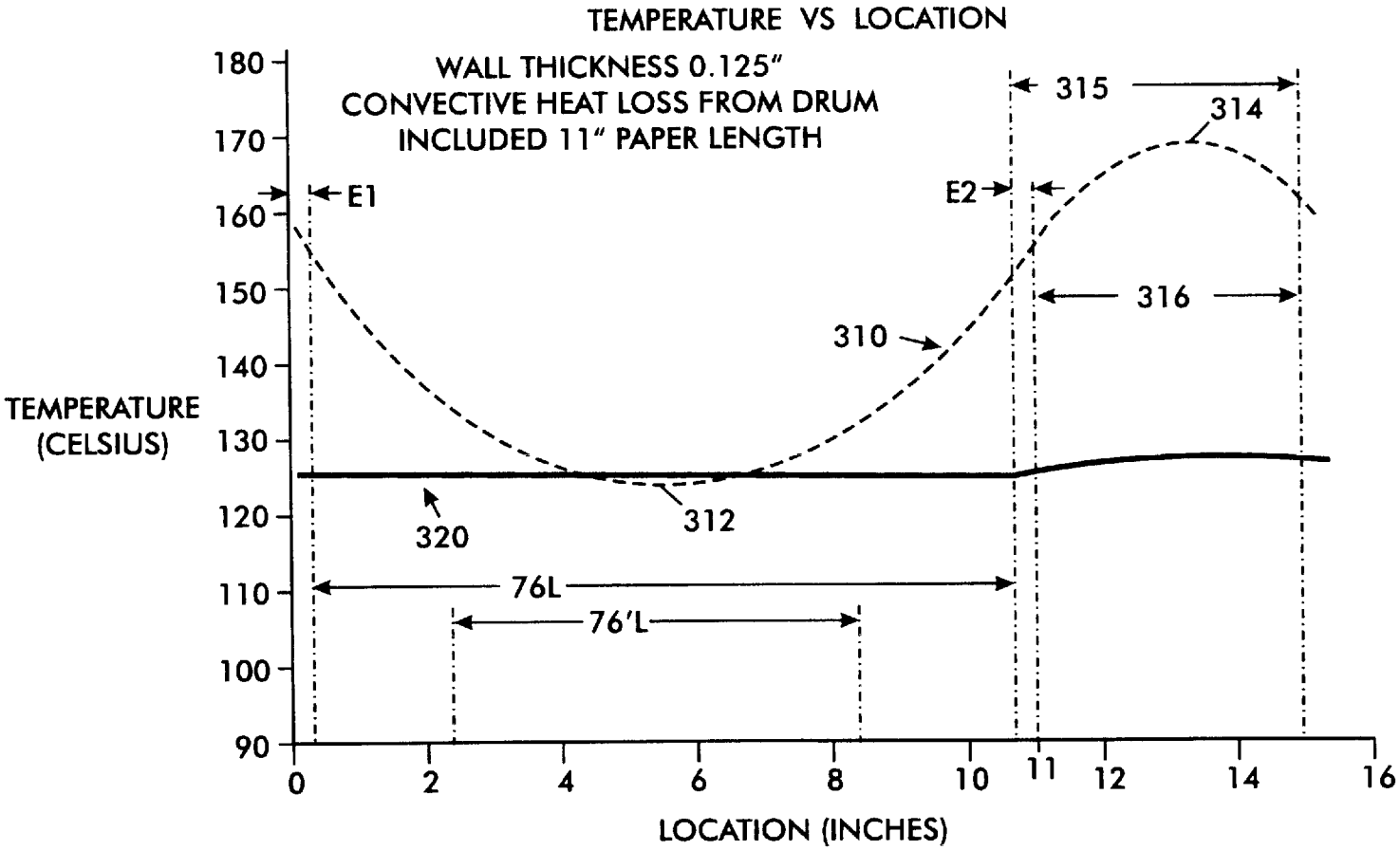
FIG. 3 is a graphical illustration of calculated circumferential surface temperature distributions measured end to end on the efficient substrate heating and supporting assembly of the present invention while running 8.5"×11" substrates, as well as a superimposed and comparative similar but non-uniform distribution for a conventional, unmodified substrate heating and supporting assembly.
Figure 4:
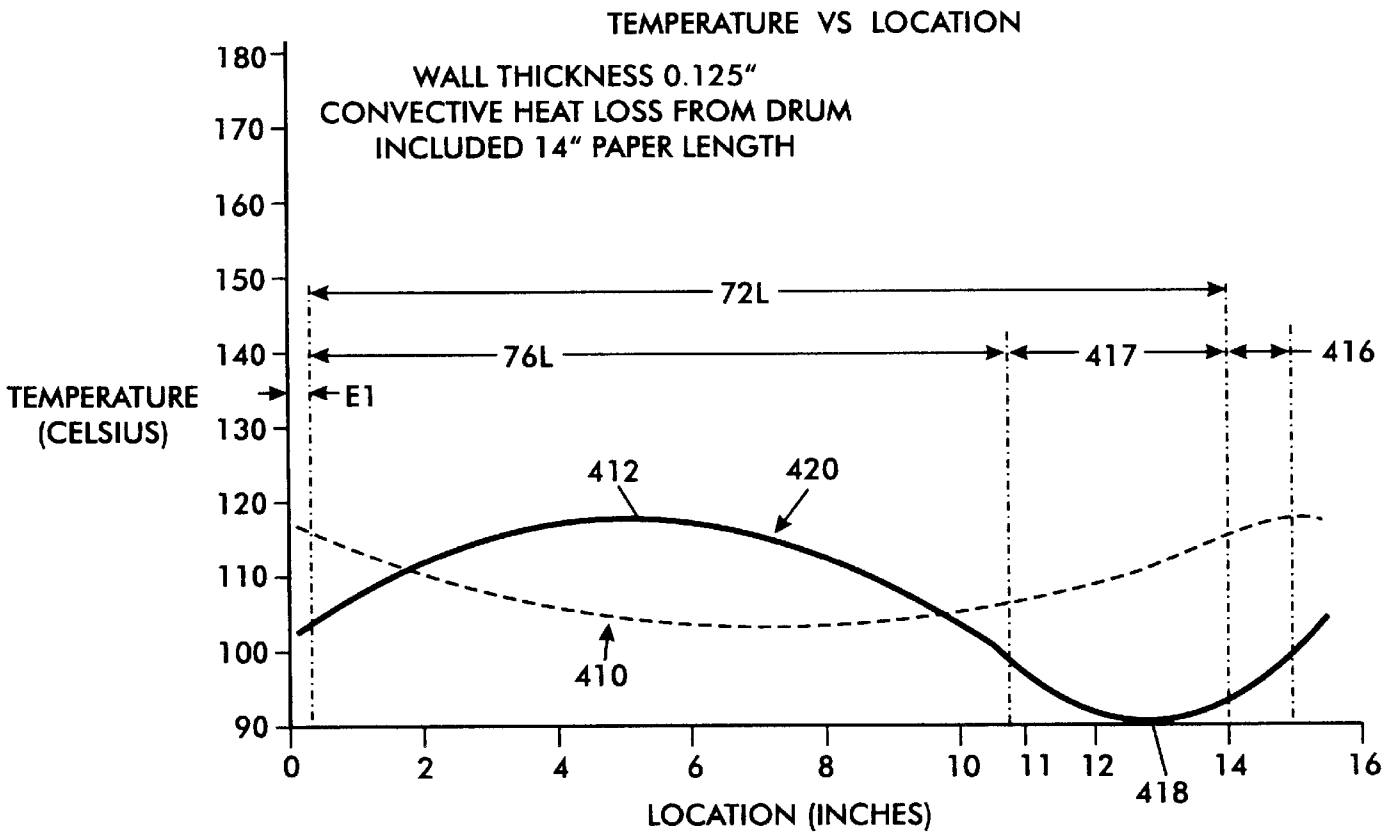
FIG. 4 is a graphical illustration similar to that of FIG. 3, but for 8.5"×14" substrates.

Referring now to FIGS. 2–4, the efficient substrate heating and supporting assembly 60 of the present invention, and its comparative and advantageous performance over conventional such assemblies, are illustrated. As shown, the efficient substrate heating and supporting assembly 60 of the present invention includes a heating device 62 that radiates heat, and a sheet or substrate supporting member or platen shown in the form of a drum, such as the drum 16, that is a hollow aluminum drum having a wall thickness of about ⅛ of an inch. Equally however, the sheet or substrate supporting member 16 can be a flat platen. In either case (of a drum or of a flat platen), the substrate supporting member 16 has a back or inner surface 64 that is located adjacent to, and facing the heating device 62. The substrate supporting member 16 also has a front surface 66 for supporting, one at a time, substrates or sheets 19 (FIG. 1) of various sizes, for example 8.5"×11" letter size sheets, and 8.5"×14" legal size sheets.

Referring in particular to FIG. 2, overall, the front surface 66 is made large enough to handle both 8.5"×11" and 8.5"×14" size sheets and still leave border areas, and thus is about 9"×15" in total front surface area. Accordingly as shown, the front surface 66 includes border areas 68 that have a polished finish for minimizing heat emissivity therefrom, and a smooth surface first substrate supporting area 70 for supporting 8.5"×11" letter size substrates. It also includes a smooth surface second substrate supporting area 72, for supporting, for example, 8.5"×14" legal size substrates. The second substrate supporting area 72 includes the first substrate supporting area 70, and an intermediate support area 74 that is located between the first substrate supporting area 70 and the border areas 68.

Still referring to FIG. 2, the back surface 64 of the substrate supporting member 16 importantly includes an increased heat absorbing area 76, (indicated alternatively as 76'L in FIG. 3) for increasing absorption of heat thereinto from the heating device 62, relative to other areas 78 of the rest of the back surface 64. The increased heat absorbing area 76, (or 76'L) is preferably roughened and thus has a surface roughness that is greater than that of the rest 78 of the back surface 64, for further increasing heat absorptivity into such area. Importantly, the increased heat absorbing area 76, or 76'L includes a heat absorbing treatment or coating such as a coating of heat absorbing paint 80, preferably a flat (as opposed to glossy) black paint. It was found experimentally that an Aluminum surface that is coated or painted properly with heat resistant black paint, absorbed heat at a much higher rate than a similar unpainted or bare Aluminum surface. The difference between the heat absorptivities of the bare Aluminum surface and the painted Aluminum is of the order of a factor of about 4. The coat is formed thereover in order to attempt to make the area 76, or 76'L, behave similarly to a black body, thus increasing its heat absorptivity. Because 8.5"×11" size substrates are the most frequently run size of substrates, the increased heat absorbing area 76, or 76'L of the back surface 64 preferably is directly opposite and centered relative to the first substrate supporting area 70 of the front surface 66 for supporting 8.5"×11" letter size substrates.

Thus in accordance with the present invention, the heat absorbing (inner) surface 64 of the drum 16 is locally modified in the area 76, or 76'L by an increased heat absorbing coating of paint or of other means, and by roughening. Such modifications advantageously induce nonuniform heat absorption into the back surface 64 in a manner to advantageously match nonuniform heat removal by substrates from the front surface 66, as discussed above. As shown in FIGS. 3, this advantageously results in relatively more uniform, adequate and efficient substrate heating and drying temperatures on the drum front surface, as shown by curve 320 FIG. 3, when continuously running the most often used substrate size, 8.5"×11". On the other hand, the front surface 66 preferably should be as smooth as possible in order to maximize the surface contact area between such front surface and a sheet being supported thereon, and in order to shorten the heat path from the drum surface to the such sheet.

In a first embodiment of the present invention, the increased heat absorbing area (shown as 76) preferably is made substantially equal to, or to correspond in size to the first substrate supporting area 70 of the front surface 66. In a second embodiment of the present invention, the increased heat absorbing area (shown as 76'L in FIG. 3) preferably has an area that is significantly less in size than that of the first substrate supporting area 70 of the front surface 66. In other words, it was found that equal or greater temperature uniformity results can be obtained in accordance with the present invention by treating as by coating or painting, by similarly enhancing the heat absorption of the back surface 64, not in an area substantially equal to the size of the letter size supporting front area 70, but only in a smaller area opposite, and at the center of the letter size substrates supporting area 70.

The advantage from doing so will be to achieve nearly uniform temperatures from end to end for the letter size substrates supporting area 70. In either case, the emissivity or absorptivity of the heat receiving (inner) surface 64 of the drum is locally modified by paint or other treatment, thereby achieving a relatively nonuniform heat absorption into the back surface, but a relatively uniform and efficient surface temperature distribution for the most often used sheet size, which is letter size.

Still referring to FIGS. 1–3, letter size (i.e. 8.5"×11") sheets or substrates 19, are fed and held onto the outer or front surface 66 of the drum 16, so that the sheet is aligned over, and centered on the first substrate supporting area 70. To the inner or backside 64 of the drum 16, heat is radiated uniformly by the heating device 62, but is advantageously absorbed nonuniformly into the walls of the inner surface 64 in accordance with the present invention. Specifically, a significantly greater amount of such heat is absorbed into the roughened and black painted or coated area 76, or 76'L, than elsewhere on such surface 64. Since the area 76, or 76'L is preferably less than or equal to, and opposite the first substrate supporting area 70 of the front surface 66, a correspondingly significantly greater amount of such heat will be conducted through the drum wall thickness to area 70 of the front surface 66, assuming equal and uniform conduction through the drum wall thickness.

It is noted again that in a printer, a given throughput rate is usually measured and expressed in terms of imprints per minute, substrate size, area coverage, and possibly in terms of other variables. The printer ordinarily is expected to maintain or support such a throughput rate for long periods of time, or indefinitely. In a properly or well designed printer of the type including a substrate heating and supporting assembly such as the member 16, an operating steady state is reached when all heat delivered to the back surface, e.g. 64, of the member 16, is removed and substantially all carried away from the front surface thereof by the substrates being run and in contact with the front surface. Relatively minor radiative and conductive losses are expected, and such losses of course can be minimized by careful design.

Ordinarily, when operating in such a steady state, the heat is expected to, and usually is delivered uniformly to the inner or back surface 64, of the drum member 16. Unfortunately, because the most commonly and frequently run substrate is the 8.5"×11" letter size and the sheet supporting front surface 66 is larger than 8.5"×11", (in order to also support 8.5"×14" substrates), heat removal from the front surface will be greater in the 8.5"×11" area and less elsewhere, and thus will be non-uniform. This is because, heat typically is removed by substrates only from the area of the drum front surface in contact with such substrates, e.g. the 8.5"×11" area. Due to such non-uniform heat removal, and to a finite, assumed uniform thermal conductivity of the wall (made of Al) of the drum member 16, the steady state temperatures of the drum surface are therefore also ordinarily, and undesirably non-uniform, see curve 310 FIG. 3.

Referring in particular to FIG. 3, there is shown a graphical illustration of a generally uniform surface temperature distribution, curve 320, when running 8.5"×11" substrates on a drum modified in accordance with the present invention. Also illustrated is a superimposed, comparative and undesirably nonuniform surface temperature distribution curve 310, obtained under similar conditions but on an unmodified conventional drum while also running 8.5"×11" sheets. For the uniform curve 320, the power level used for the calculations was adjusted in order to achieve a temperature of at least 125° C. on all areas (end to end) of the 11" sheet supporting area 70 (FIG. 2) of the drum. It was determined that for the modified drum case according to the present invention, this required a power level of about 764 watts.

The horizontal axis of the graph represents the 15" length of the drum, with substrate registration at a near end shown having an unpainted margin E1. The painted or modified portion has a length shown as 76L that is preferably 10.5" from the near end margin E1. The margin E1 measured circumferentially preferably is about a quarter of an inch. The length 76L of the modified portion is centered relative to the surface substrate supporting area 70 (FIG. 2), therefore leaving an opposite margin E2 also of about a quarter inch at the distal and opposite end of the drum surface from E1. As shown, this would amount to an unpainted or unmodified portion having a total length, shown as 315 towards the distal end, with an unpainted, unused portion having a length 316. The unused portion is of course that portion of the drum surface not being contacted by the 8.5"×11" substrates or sheets being run.

Referring still to FIG. 3, the superimposed conventional temperature curve 310 indicates temperatures that are lower in the sheet or substrate supporting area under the continually fed sheets (8.5"×11"), that is, the area 70 (FIG. 2). As this curve 310 shows, conventionally, surface temperatures are generally nonuniform in an end to end direction of sheet support on the drum 16 (FIG. 2), and are generally higher towards the near and distal ends than at the middle or center 312 of the sheet supporting area. A minimum temperature according to this curve occurs in the middle or center 312 of the sheet supporting area, and a maximum temperature occurs at the center 314 of the unused portion 316.

Calculations for the curve 310 assumed uniform heat absorption into all areas of the conventional inner surface 64 of the drum, and took into account heat removed by the substrates or sheets, as well as, convective heat loss to the environment. The power level used for the calculations was adjusted in order to achieve a temperature of at least 125° C. on all areas (end to end) of the 11" sheet supporting area of the drum, particularly in the center portion 312 thereof, thus resulting in much higher temperatures of more than 155° C. towards the ends, as shown. It was determined that for the unmodified drum case, this required a relatively higher power level of about 820 watts. This is an undesirable situation.

In this conventional case, the higher temperatures of more than 155° C. towards the near and distal ends of the sheet supporting area, as well as, the much higher temperatures shown in the unused or non-substrate supporting area 316, disadvantageously result in an undesirable power loss to the environment. In addition, the higher temperatures of more than 155° C towards the near and distal end of the sheet supporting area (which are more than 30° C. hotter than the desired temperature in the center 312 of the sheet supporting area) will tend to have an adverse effect on the appearance of the sheets in contact with those ends. Furthermore, such a significant difference of more than 30° C. in temperature between portions of the drum surface will tend to cause the drum wall to deform, and thus may make the drum less effective in supporting and heating substrates.

The solution to these disadvantages is provided of course by the present invention, as above, in which the inner surface 64 (FIG. 2) of the drum under the front area 70 which is repeatedly used for supporting and heating letter size sheets, is made to absorb heat thereinto, nonuniformly. Thus as shown in FIG. 3, the temperature curve 320 on a drum modified in accordance with the present invention, indicates surface temperatures that under similar circumstances as, but at less power than, the conventional drum, are comparatively lower, and significantly more uniform than those shown by curve 310. As this curve 320 shows, surface temperatures are about the same level at the middle or center 312, and are particularly lower comparatively towards the near and distal ends of the sheet supporting area. Temperatures as expected, are higher in the unused portion 316 of the drum, than elsewhere along the curve. As a result of the lower or reduced (peak) end to end surface temperatures in accordance with the present invention, the power level required for maintaining the required minimum temperature of at least 125° C. (in order to assure proper heating and drying of images on the supported sheets) can advantageously be reduced below the conventional level of 820 watts, or for the conventional level of 820 watts, the printer throughput rate can be increased without a loss in image quality.

Referring in particular to FIG. 4, there is shown a graphical illustration of a generally nonuniform and undesirable surface temperature distribution, curve 420, when running 8.5"×14" substrates on a drum modified in accordance with the present invention for efficient running of 8.5"×11' sheets. Also shown is a superimposed, comparatively more uniform surface temperature distribution curve 410, obtained under similar conditions but on an unmodified conventional drum when running 8.5"×14" sheets. As above, the horizontal axis of the graph represents the 15" length of the drum, with substrate registration at the near end shown having an unpainted margin E1. The painted or modified portion has the length shown as 76L that as above, and is preferably 10.5" from the near end margin E1. The margin E1 measured circumferentially preferably is about a quarter of an inch. The length 76L of the modified portion is centered relative to the surface substrate supporting area 70 (FIG. 2). That therefore leaves an unpainted or unmodified portion 417 within the second substrate supporting area 72 (FIG. 2) shown having a length 72L. There is then left an untreated or unpainted and unused portion 416 towards the distal end, that is, the fifteen inch end of the drum. The unused portion 416 is of course that portion of the drum surface not being contacted by the 8.5"×14" substrates or sheets being run.

As shown by the nonuniformity of the curve 420 (obtained in accordance with the present invention), a slight price in nonuniformity will be paid when a modified drum (modified in accordance with the present invention for efficiently running 8.5"×11" substrates) is used for a long continuous run of 8.5"×14" substrates. This price as shown is a significant temperature non-uniformity, (see temperature at point 412 and that at point 418), that develops during such a sustained run of legal size sheets on such a modified drum. Such nonuniformity during such a run will tend to lead to a reduction in the throughput rate during continuous running of legal size (8.5"×14") sheets. However, since such sustained runs of legal size (8.5"×14") sheets are ordinarily rare and not frequent, it is believed that such a slight price or inefficiency is an acceptable trade off for the major power loss and heating efficiency improvement gained when running the most frequently run size, i.e. (8.5"×11") sheets, on the same drum. In an office where the most frequently run size substrates is the legal or 8.5"×14" sheets, it would of course be unadvisable to modify the drum in accordance with the present invention.

Model computations carried out for providing quantitative support for this invention assumed that the image bearing substrates or sheets remove heat from the drum surface at a rate of 0.9 watts/cm$^2$ for steady state operations if the temperature of the surface was 125° C. It was also assumed that proportionally lower power densities occurred in those areas heated to less than 125° C., and more in those areas heated to greater than 125° C. As pointed out above, convective heat loss from the surface of the drum was taken into account. Further, it was assumed that the painted portion of the drum's inner surface absorbs power at a rate which is about four times that of the unpainted portion of such surface, and that when unpainted, the entire inner surface absorbs heat uniformly.

In FIG. 3, the curve 320 shows the temperature distribution under the above assumptions for steady-state running of 8.5"×11" sheets on a modified drum having a painted portion of 10.5" in length measured end to end, and requiring an input power level of 764 watts. The 764 watts is a significantly lower power level than the 820 watts for the conventional case. As the curve 320 shows, the uniformity of the temperatures in the modified drum case, with the 10.5" painted portion, is quite obviously improved when compared to the unpainted, conventional case as shown by the nonuniform curve 310.

The results of calculations using the assumptions above-(10.5" painted portion found above to be optimal for the 11" sheet, and the same 764 watt power input), as shown by the curve 420 of FIG. 4, were found not to be optimal for legal size, 8.5"×14" sheets. As the curve 420 shows, the surface temperatures are all lower than the 125° C. which as determined above, is required for drying the printed sheets in the time allowed at the throughput rate. This over-all reduction in temperatures as illustrated by this curve is believed to be due to the increased amount of heat removed by the longer 14" long sheet as compared to the shorter 11" sheet.

On the other hand, the curve 410 of FIG. 4 illustrates the temperature distribution that would result in a conventional drum as described above, for the same power of 764 watts input. As shown, for this case, the temperature uniformity is significantly improved relative to the curve 420, however the minimum temperature is still below the 125° C. value which, as above, is required for proper image drying in the allotted time. Therefore, unless more power is available for the image drying function, the page throughput rate would need to be decreased. Decreasing the page throughput rate has a doubly-beneficial effect since a longer paper residence time allows drying to occur at a lower temperature, and the rate at which heat is removed by the sheet is reduced.

Needless to say, many useful modifications of this invention are possible. The absorptivity of the inner drum surface can be controlled in a more distributed way. A smaller or larger portion of the inner surface of the drum can have its absorptivity increased for nonuniform heat absorption, thus resulting in a more uniform surface temperatures distribution when running the most often-run size of sheets. For relatively beneficial results, rarely run size sheets should be run at a reduced throughput rate. As such, it may be possible to use thinner wall drums, thus reducing the warm up and cool down times for such a drum. Such a thinner wall drum will be particularly useful when clearing jams, and for running transparency substrates. As pointed out above, the absorptivity of the inner surface can be increased further by roughening the portion or area 76 (FIG. 2), 76'L (FIG. 3) of the inner surface. Furthermore, it is understood that a nonuniform heat absorption by the inner surface can be obtained by other surface treatments or by thermal radiation shielding, and still be within the spirit of the present invention.

As can be seen, there has been provided a thermal ink jet printer including a frame, a printhead mounted to the frame for printing ink images onto a heated and supported substrate, and an efficient substrate heating and supporting assembly mounted to the frame. The efficient substrate heating and supporting assembly includes a heating device, and a substrate supporting member having a front surface including a substrate supporting area for supporting substrates of various sizes one at a time. The efficient substrate heating and supporting assembly also includes a heat absorbing back surface facing the heating device. The heat absorbing back surface includes an increased heat absorbing area located opposite the substrate supporting area on the front surface. The increased heat absorbing area, relative to a rest of the back surface, has a coat of paint thereon for increasing heat absorption thereinto from the heating device, thereby resulting advantageously in relatively nonuniform heat absorption into the back surface, and relatively more uniform, adequate and efficient substrate heating and drying temperatures on the front surface, when continuously running a most often used size of substrates.

While the present invention has been described with reference to a preferred embodiment, it will be appreciated from this teaching that within the spirit of the present invention, various alternative modifications, variations or improvements therein may be made by those skilled in the art.

What is claimed is:

1. A thermal ink jet printer comprising:

(a) a frame;

(b) a printhead mounted to said frame for printing ink images onto a heated and supported substrate; and (c) a substrate heating and supporting assembly mounted to said frame, said heating and supporting assembly including:

(i) a heating device; and (ii) a substrate supporting member having a front surface including a substrate supporting area for supporting substrates of various sizes one at a time, and a heat absorbing back surface facing said heating device, said heat absorbing back surface including an increased heat absorbing area located opposite and centered relative to said substrate supporting area on said front surface, said increased heat absorbing area, relative to a rest of said back surface, having a coat of heat absorbing paint thereon for increasing heat absorption thereinto from said heating device, and said front surface including border areas surrounding said substrate supporting area and having a polished finish for minimizing heat emissivity therefrom, thereby resulting advantageously in relatively non-uniform heat absorption into said back surface, and in relatively more uniform, adequate and efficient substrate heating and drying temperatures on said front surface, when continuously running a most often run size of substrates.

2. The thermal ink jet printer of claim 1, wherein said substrate supporting area comprises a first substrate supporting area for supporting 8.5"×11" letter size substrates, and an intermediate area between said border areas and said first substrate supporting area for, in addition to said first substrate supporting area, supporting substrates greater than 8.5"×11" letter size substrates.

3. The thermal ink jet printer of claim 1, wherein said substrate supporting member is a hollow drum.

4. The thermal ink jet printer of claim 1, wherein said coat of heat absorbing paint comprises a coat of black paint.

5. The thermal ink jet printer of claim 4, wherein said coat of black paint is a coat of flat black paint.

6. An efficient substrate heating and supporting assembly in an ink jet printing apparatus, the efficient substrate heating and supporting assembly comprising:

(a) a heating device; and (b) a substrate supporting member having a front surface including a substrate supporting area for supporting substrates of various sizes one at a time, and a heat absorbing back surface facing said heating device, said heat absorbing back surface including an increased heat absorbing area located opposite said substrate supporting area on said front surface, said increased heat absorbing area being centered relative to, and significantly less in area than, said substrate supporting area, and said increased heat absorbing area, relative to a rest of said back surface, having a coat of heat absorbing paint thereon for increasing heat absorption thereinto from said heating device, thereby resulting advantageously in relatively nonuniform heat absorption into said back surface, and in relatively more uniform, adequate and efficient substrate heating and drying temperatures on said front surface, when continuously running a most often run size of substrates.

7. The efficient substrate heating and supporting assembly of claim 6, wherein said front surface includes a substrate supporting area having a size sufficient for supporting 8.5"×14" substrates.

8. An efficient substrate heating and supporting assembly in an ink jet printing apparatus, the efficient substrate heating and supporting assembly comprising:

(a) a heating device; and (b) a substrate supporting member having a front surface including a substrate supporting area for supporting substrates of various sizes one at a time, and a heat absorbing back surface facing said heating device, said heat absorbing back surface including an increased heat absorbing area located opposite said substrate supporting area on said front surface, and said increased heat absorbing area having both a coat of heat absorbing paint and a surface roughness greater than that of a rest of said back surface for increasing heat absorption thereinto from said heating device, and said front surface including border areas surrounding said substrate supporting area and having a polished finish for minimizing heat emissivity therefrom, thereby resulting advantageously in relatively nonuniform heat absorption into said back surface, and in relatively more uniform, adequate and efficient substrate heating and drying temperatures on said front surface, when continuously running a most often run size of substrates.

9. A thermal ink jet printer comprising:

(a) a frame;

(b) a printhead mounted to said frame for printing ink images onto a heated and supported substrate; and (c) a substrate heating and supporting assembly mounted to said frame, said heating and supporting assembly including:

(i) a heating device; and (ii) a substrate supporting member including front surface border areas having a polished surface finish for minimizing heat emissivity therefrom; a front surface area within said border areas for supporting substrates of various sizes one at a time; and a heat absorbing back surface facing said heating device, said heat absorbing back surface including an increased heat absorbing area located opposite said front surface substrate supporting area, and said increased heat absorbing area, relative to a rest of said back surface, having a greater surface roughness and a coat of heat absorbing paint thereon for increasing heat absorption thereinto from said heating device, thereby resulting advantageously in relatively nonuniform heat absorption into the back surface, and relatively in more uniform, adequate and efficient substrate drying temperatures on said front surface, even when continuously running a most often used size of substrates.

10. The efficient substrate heating and supporting assembly of claim 9, wherein said coat of paint comprises a heat resistant black paint.

* * * * *